US008897668B2

(12) United States Patent
Kaneko et al.

(10) Patent No.: US 8,897,668 B2
(45) Date of Patent: Nov. 25, 2014

(54) CLEANING DEVICE AND IMAGE FORMING APPARATUS INCLUDING THE SAME

(75) Inventors: Atsushi Kaneko, Kanagawa (JP); Kazuyoshi Hagiwara, Kanagawa (JP); Masaaki Tokunaga, Kanagawa (JP); Kazutoshi Sugitani, Kanagawa (JP); Koichi Sato, Kanagawa (JP); Tsutomu Komiyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 260 days.

(21) Appl. No.: 13/485,131

(22) Filed: May 31, 2012

(65) Prior Publication Data

US 2013/0142540 A1 Jun. 6, 2013

(30) Foreign Application Priority Data

Dec. 2, 2011 (JP) ..... 2011-264624

(51) Int. Cl.
*G03G 15/16* (2006.01)

(52) U.S. Cl.
CPC ..... *G03G 15/168* (2013.01); *G03G 15/161* (2013.01)
USPC ..... 399/101

(58) Field of Classification Search
CPC ..... G03G 15/161; G03G 15/168
USPC ..... 399/101
See application file for complete search history.

(56) References Cited

U.S. PATENT DOCUMENTS

| | | | | |
|---|---|---|---|---|
| 5,822,666 | A * | 10/1998 | Haneda et al. | 399/309 |
| 5,963,769 | A * | 10/1999 | Emukai et al. | 399/297 |
| 2002/0076227 | A1 * | 6/2002 | De Jong et al. | 399/66 |
| 2005/0254852 | A1 * | 11/2005 | Kitagawa | 399/101 |
| 2007/0122171 | A1 * | 5/2007 | Fujimori et al. | 399/38 |
| 2009/0324306 | A1 * | 12/2009 | Echigo et al. | 399/314 |

FOREIGN PATENT DOCUMENTS

| | | | |
|---|---|---|---|
| JP | 2005-157122 | A | 6/2005 |
| JP | 3940158 | B2 | 7/2006 |
| JP | 2011-022582 | A | 2/2011 |

* cited by examiner

*Primary Examiner* — David Gray
*Assistant Examiner* — Thomas Giampaolo, II
(74) *Attorney, Agent, or Firm* — Sughrue Mion, PLLC

(57) ABSTRACT

A cleaning device includes first to third cleaning members that clean a surface of an endless belt that is looped over rollers including a driving roller. The first cleaning member is brought into contact with and separated from the surface at a predetermined timing. The second cleaning member is disposed upstream of the first cleaning member and downstream of the driving roller in a movement direction of the endless belt. The second cleaning member is in contact with the endless belt so as to prevent a tension variation of the endless belt caused by the first cleaning member from affecting the driving roller. The third cleaning member is disposed downstream of the first cleaning member. A contact state in which the third cleaning member is in contact with the endless belt is switched from a first contact state to a second contact state so as to reduce the tension variation.

8 Claims, 7 Drawing Sheets

CLEANING DEVICE AND IMAGE FORMING APPARATUS INCLUDING THE SAME

CROSS-REFERENCE TO RELATED APPLICATIONS

This application is based on and claims priority under 35 USC 119 from Japanese Patent Application No. 2011-264624 filed Dec. 2, 2011.

BACKGROUND

Technical Field

The present invention relates to a cleaning device and an image forming apparatus including the cleaning device.

SUMMARY

According to an aspect of the invention, a cleaning device includes a first cleaning member that is brought into contact with and separated from a surface of an endless belt at a predetermined timing and cleans the surface, the endless belt being looped over plural rollers including a driving roller; a second cleaning member that cleans the surface of the endless belt, the second cleaning member being disposed upstream of the first cleaning member and downstream of the driving roller in a movement direction in which the endless belt moves, the second cleaning member being in contact with the endless belt so as to prevent a tension variation in a tension of the endless belt from affecting the driving roller, the tension variation occurring when the first cleaning member is brought into contact with and separated from the endless belt; and a third cleaning member that cleans the surface of the endless belt, the third cleaning member being disposed downstream of the first cleaning member in the movement direction of the endless belt, a contact state in which the third cleaning member is in contact with the endless belt being switched from a first contact state to a second contact state so as to reduce the tension variation, which occurs when the first cleaning member is brought into contact with and separated from the endless belt.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

First Embodiment

Figure 2:
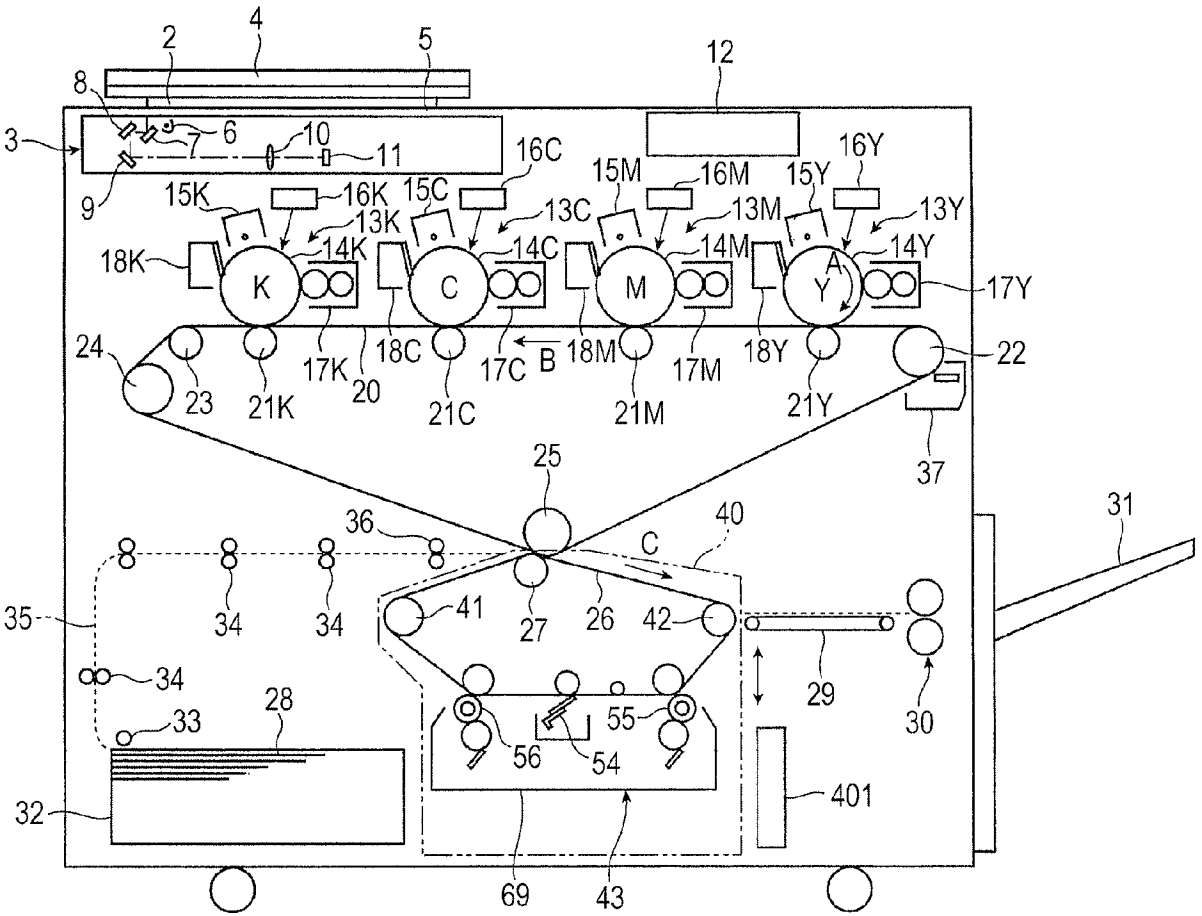
FIG. 2 is a schematic view of the image forming apparatus including the cleaning device according to the first exemplary embodiment of the present invention.

FIG. 2 illustrates a tandem full-color image forming apparatus including a cleaning device according to a first exemplary embodiment of the present invention. The tandem full-color image forming apparatus includes an image reader, so that the apparatus also functions as a full-color copier. However, the image reader may be omitted.

In FIG. 2, an image reader 3, which reads an image of a document 2, is disposed in an upper end portion (upper left end portion in this example) of an image forming apparatus body 1. In the image reader 3, the document 2 is irradiated with light emitted by a light source 6 while the document 2 is placed on a platen glass 5 and is pressed by a document pressing member 4. Light reflected from the document 2 passes through a reduction optical system, which includes a full-rate mirror 7, half-rate mirrors 8 and 9, and an imaging lens 10; and the light is scanned over an image reading element 11 such as a CCD. Thus, the image reading element 11 reads an image of the document 2 with a predetermined dot pitch.

The image of the document 2, which has been read by the image reader 3, is sent to an image processor 12 as, for example, image data of three colors that are red (R), green (G), and blue (B). The image processor 12 performs, on the image data of the document 2, predetermined image processing operations such as shading correction, displacement correction, brightness/color conversion, gamma correction, frame erasing, and color/movement edition. The image data, which has been subjected to the predetermined image processing operations by the image processor 12, is converted to image data of four colors that are cyan (C), magenta (M), yellow (Y), and black (K) by the image processor 12. The colors of image data converted by the image processor 12 are not limited to these four colors, which are cyan (C), magenta (M), yellow (Y), and black (K). Alternatively, the colors may be six colors including high-chroma cyan (HC) and high-chroma magenta (HM). Further alternatively, the number of colors may be any appropriate number. Image data may be input to the image processor 12 from a personal computer or the like through a communication line (not shown).

The present exemplary embodiment includes plural image forming units that form images by using toners of different colors.

That is, as illustrated in FIG. 2, in the image forming apparatus body 1 according to the present exemplary embodiment, image forming units 13Y, 13M, 13C, and 13K, which respectively correspond to yellow (Y), magenta (M), cyan (C), and black (K) are parallelly arranged along a horizontal direction at a regular pitch. The image forming units 13Y, 13M, 13C, and 13K for yellow (Y), magenta (M), cyan (C), and black (K) may be arranged in an order different from that of FIG. 2.

Each of the image forming units 13Y, 13M, 13C, and 13K for yellow (Y), magenta (M), cyan (C), and black (K) is an integrated unit. The image forming units 13Y, 13M, 13C, and 13K, excluding image exposure devices 16Y, 16M, 16C, and 16K described below, are independently removable from the image forming apparatus body 1.

As illustrated in FIG. 2, the four image forming units 13Y, 13M, 13C, and 13K have the same structure except for the type of toner used. Each of the image forming units includes a photoconductor drum 14, a scorotron 15, an image exposure device 16, a developing device 17, and a cleaning device 18. The photoconductor drum 14, which is an example of an image carrier, is driven at a predetermined rotation speed in the direction of arrow A. The scorotron 15, which is an example of a first charger, uniformly charges a surface of the photoconductor drum 14. The image exposure device 16, which is an example of a latent image forming unit, exposes the surface of the photoconductor drum 14 so as to form an electrostatic latent image of a corresponding color. The developing device 17 develops the electrostatic latent image formed on the photoconductor drum 14 by using toner of the corresponding color. The cleaning device 18 removes residual toner and the like remaining on the photoconductor drum 14.

The photoconductor drums 14Y, 14M, 14C, and 14K of the image forming units 13Y, 13M, 13C, and 13K for yellow (Y), magenta (M), cyan (C), and black (K) are charged to a predetermined negative potential by scorotrons 15Y, 15M, 15C, and 15K. Subsequently, the image processor 12 successively outputs image data of corresponding colors to the image exposure devices 16Y, 16M, 16C, and 16K of the image forming units 13Y, 13M, 13C, and 13K for yellow (Y), magenta (M), cyan (C), and black (K). The image exposure devices 16Y, 16M, 16C, and 16K emit laser beams LB in accordance with the image data; the surfaces of the corresponding photoconductor drums 14Y, 14M, 14C, and 14K are scanned by the laser beams in the main scanning direction (the axial direction of the photoconductor drum); and thereby electrostatic latent images are formed on the surfaces of the photoconductor drums 14Y, 14M, 14C, and 14K. The developing devices 17Y, 17M, 17C, and 17K reversely develop the electrostatic latent images, which have been formed on the photoconductor drums 14Y, 14M, 14C, and 14K, to form toner images composed of negatively charged toners of yellow (Y), magenta (M), cyan (C), and black (K).

As illustrated in FIG. 2, an intermediate transfer belt 20, which is an example of an intermediate transfer member, is disposed below the image forming units 13Y, 13M, 13C, and 13K. The toner images of yellow (Y), magenta (M), cyan (C), and black (K), which have been successively formed on the photoconductor drums 14Y, 14M, 14C, and 14K of the image forming units 13Y, 13M, 13C, and 13K, are overlappingly first-transferred to the intermediate transfer belt 20 in first-transfer regions by first transfer rollers 21Y, 21M, 21C, and 21K.

The intermediate transfer belt 20 is looped over plural rollers including a driving roller 22, a driven roller 23, a tension roller 24, and a back-support roller 25 with a predetermined tension. The back-support roller is disposed in a second transfer region. The driving roller 22 is rotated by a dedicated driving motor (not shown) that is capable of rotating at a highly constant speed. The intermediate transfer belt 20 is driven by the driving roller 22 in the direction of arrow B at a predetermined speed that is substantially the same as the rotation speed (circumferential speed) of the photoconductor drums 14Y, 14M, 14C, and 14K. The intermediate transfer belt 20 is, for example, an endless-belt-shaped synthetic resin film that is made from a plastic resin such as a polyimide resin or a polyamide-imide resin.

A second transfer roller 27 is in pressed contact with the back-support roller 25 with the intermediate transfer belt 20 and a second transfer belt 26 therebetween, and a second transfer bias voltage is applied to the second transfer roller 27. The toner images of yellow (Y), magenta (M), cyan (C), and black (K), which have been overlappingly transferred to the intermediate transfer belt 20, are simultaneously second-transferred to a recording sheet 28, which is an example of a recording medium, due to the second transfer voltage. After the toner images of the four colors have been transferred, the recording sheet 28 is peeled off the second transfer belt 26 and transported by a transport belt 29 to a fixing device 30, which is an example of a fixing unit. The fixing device 30 fixes the toner images, which have been transferred to the recording sheet 28, onto the recording sheet 28 by using heat and pressure. Then, the recording sheet 28 is output to an output tray 31 that is disposed outside of the image forming apparatus body 1.

As illustrated in FIG. 2, the recording sheet 28, which has a predetermined size and quality, is picked up from a feed tray 32 and separated from other sheets by a feed roller 33 and a pair of sheet separation rollers (not shown), and the recording sheet 28 is transported to a registration roller 36 along a sheet transport path 35, along which plural transport rollers 34 are arranged. The recording sheet 28, which has been supplied from the feed tray 32, is transported to a second transfer position by the registration roller 36, which is rotated at a predetermined timing, in synchronism with the toner images on the intermediate transfer belt 20.

The cleaning devices 18Y, 18M, 18C, and 18K cleans the surfaces of the photoconductor drums 14Y, 14M, 14C, and 14K from which the toner image have been first-transferred. A belt cleaning device 37, which is disposed adjacent to the driving roller 22, cleans the surface of the intermediate transfer belt 20 from which the toner images have been second-transferred.

As illustrated in FIG. 2, the present exemplary embodiment includes a second transfer unit 40 that includes a second transfer belt 26. The second transfer belt 26 is an endless belt looped over plural rollers including the second transfer roller 27. The second transfer unit 40 simultaneously second-transfers the toner images from the intermediate transfer belt 20 to the recording sheet 28.

The second transfer unit 40 is an integrated unit. The second transfer unit 40 is movable by a contact/separation mechanism 401 in directions such that the second transfer belt 26, which is looped over the second transfer roller 27, is brought into contact with and separated from the intermediate transfer belt 20.

Figure 1:
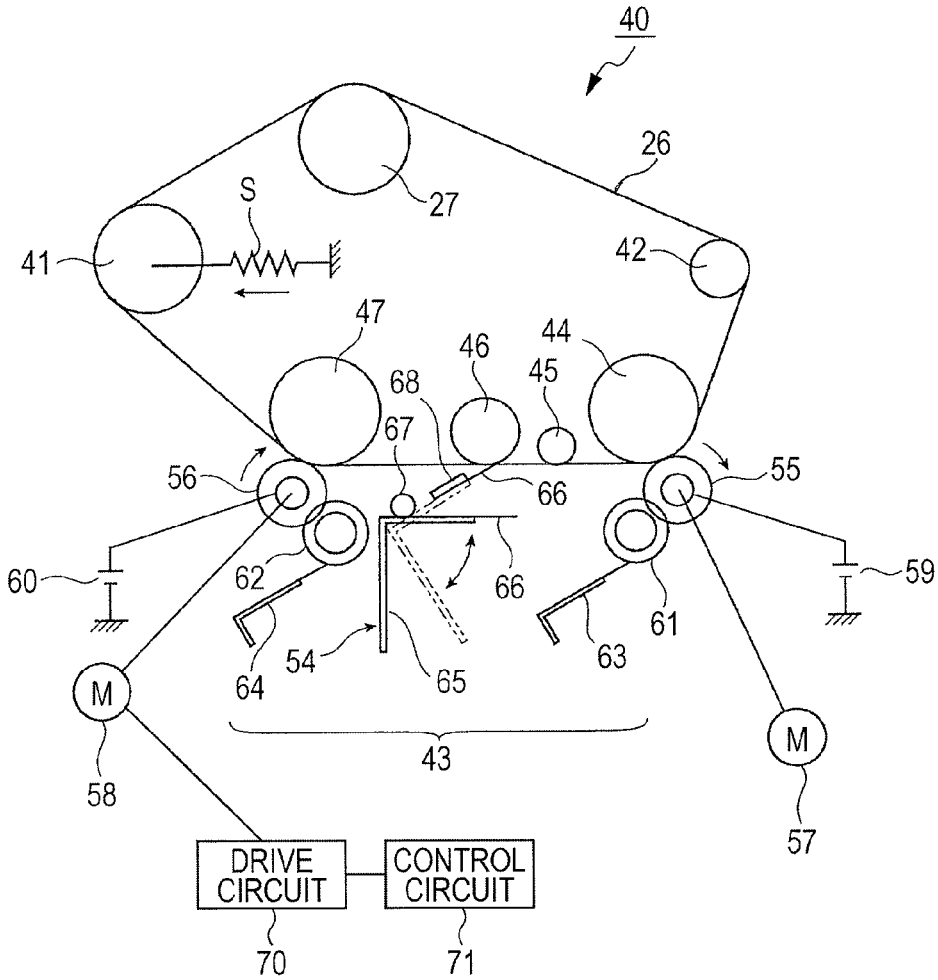
FIG. 1 is a partial schematic view of an image forming apparatus including a cleaning device according to a first exemplary embodiment of the present invention.

As illustrated in FIG. 1, the second transfer unit 40 includes the second transfer belt 26, the second transfer roller 27, a meandering control roller 41, a peel-off roller 42, a cleaning device 43, and plural support rollers. The second transfer belt 26 is an endless belt. The second transfer roller 27 is disposed at the second transfer position, at which the second transfer roller 27 is in contact with the intermediate transfer belt 20, and drives the second transfer belt 26. The meandering control roller 41 is disposed upstream of the second transfer roller 27 in the movement direction of the second transfer belt and controls meandering of the second transfer belt 26. The peel-off roller 42, which has a relatively small diameter, is disposed downstream of the second transfer roller 27 in the movement direction of the second transfer belt 26, and peels the recording sheet 28 off the second transfer belt 26. The cleaning device 43 removes residual substances remaining on a surface of the second transfer belt 26. The plural support rollers, which are first to fourth support rollers 44 to 47 in the example of FIG. 1, support the second transfer belt 26 so that the second transfer belt 26 faces the cleaning device 43.

The meandering control roller 41 controls meandering of the second transfer belt 26 by moving, in a direction that intersects the axial direction, the position of an end thereof in the axial direction on the basis of, for example, an output of an edge sensor (not shown) that detects an edge of the second transfer belt 26. A coil spring S, which is an example of an elastic member, applies a force to the meandering control roller 41 in a direction extending from the inside toward the outside of the second transfer belt 26, and thereby a predetermined tension (of, for example, about 40 N) is applied to the second transfer belt 26.

As with the intermediate transfer belt 20, the second transfer belt 26 is, for example, an endless-belt-shaped synthetic resin film that is made from a plastic resin such as a polyimide resin or a polyamide-imide resin.

Figure 3:
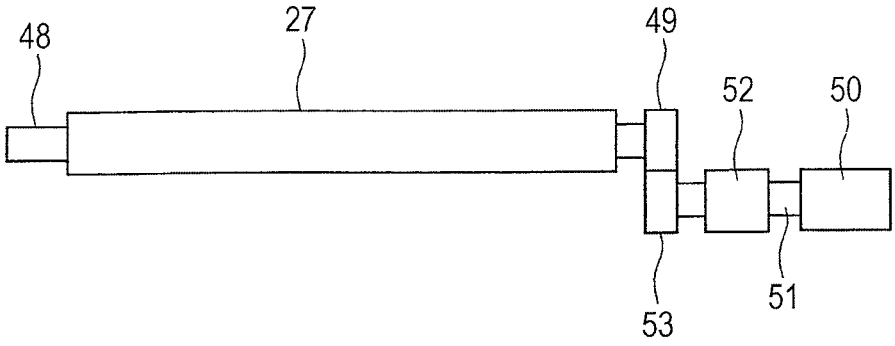
FIG. 3 is a schematic view of a driving system for driving a second transfer roller.

The second transfer roller 27 functions as a driving roller that drives the second transfer belt 26 in the direction of arrow C at a predetermined speed that is slightly higher than that of the intermediate transfer belt 20. As illustrated in FIG. 3, a driven gear 49 is attached to an end of a rotary shaft 48 of the second transfer roller 27. The driven gear 49 meshes with a drive gear 53 that is connected to and driven by a drive shaft 51 of a driving motor 50 via a torque limiter 52. The torque limiter 52, which is an example of a torque limiting unit, transmits only a torque that is equal to or smaller than a set value. The second transfer belt 26 is driven by the second transfer roller 27 at a speed that is slightly (for example, about several percent) higher than that of the intermediate transfer belt 20. This prevents fluctuation in the speeds of the second transfer belt 26 and the intermediate transfer belt 20, which may occur when the leading end of the recording sheet 28 arrives at the second transfer position, at which the second transfer belt 26 and the intermediate transfer belt 20 are in pressed contact with each other, and thereby a load applied to the second transfer belt 26 and the intermediate transfer belt 20 momentarily increases. Thus, occurrence of an image defect (so-called banding) in a toner image that is transferred from the intermediate transfer belt 20 to the leading end of the recording sheet 28 is prevented.

The torque limiter 52, which is included in the driving system for driving the second transfer roller 27, transmits only a torque that is equal to or smaller than a set value in order to prevent occurrence of an image defect that is so-called banding. However, the set value of the torque limiter 52 should not be too high, because, if the set value of the torque limiter 52 is too high, an image defect (so-called banding) may occur due to a mismatch between the speed of the second transfer belt 26 and the speed of the intermediate transfer belt 20. On the other hand, if the set value of the torque limiter 52 is too low, the effect of preventing occurrence of an image defect (so-called banding) is not sufficiently obtained.

As illustrated in FIG. 1, the cleaning device 43 for cleaning the second transfer belt 26 includes a cleaning blade 54, an upstream cleaning brush 55, and a downstream cleaning brush 56. The cleaning blade 54, which is an example of a first cleaning member, is brought into contact with and separated from the surface of the second transfer belt 26 at a predetermined timing and cleans the surface of the second transfer belt 26. The upstream cleaning brush 55, which is an example of a second cleaning member, is disposed upstream of the cleaning blade 54 and downstream of the second transfer roller 27 in a movement direction in which the second transfer belt 26 moves, and cleans the surface of the second transfer belt 26. The downstream cleaning brush 56, which is an example of a third cleaning member, is disposed downstream of the cleaning blade 54 and upstream of the meandering control roller 41 in the movement direction of the second transfer belt 26, and cleans the surface of the second transfer belt 26.

As illustrated in FIG. 1, the cleaning blade 54 is disposed so that the cleaning blade 54 is brought into contact with and separated from a part of the surface of the second transfer belt 26 that is supported by the third support roller 46. The cleaning blade 54 includes a support member 65 and a blade member 66. The support member 65 is substantially L-shaped. The blade member 66 is a thin plate made from a metal such as aluminium or a stainless steel, which is attached to the distal end of the support member 65 by using an adhesive or the like. The cleaning blade 54 is rotatable between a contact position and a separation position around a rotation shaft 67 that is attached to the proximal end of the support member 65. When the cleaning blade 54 is at the contact position, the distal end of the blade member 66 is in contact with the surface of the second transfer belt 26 such that the distal end scrapes the surface at a predetermined scraping depth. When the cleaning blade 54 is at the separation position, the distal end of the blade member 66 is separated from the surface of the second transfer belt 26. Movement of the cleaning blade 54 beyond the contact position is restrained by a stopper 68 that is disposed so that the cleaning blade 54 scrapes the surface of the second transfer belt 26 at a predetermined scraping depth. The cleaning blade 54 may be a flat plate-shaped member made from a synthetic resin such as a polyurethane rubber. The cleaning blade 54 is disposed such that the proximal end thereof is located on the downstream side and the distal end thereof is located on the upstream side in the movement direction of the second transfer belt 26. The cleaning blade 54 is brought into contact with the second transfer belt 26 while the cleaning blade 54 is oriented in a direction extending from the downstream side toward the upstream side with respect to the movement direction of the second transfer belt 26, which is opposite to the rotation direction of the second transfer belt 26. The cleaning blade 54 is a so-called doctor blade.

Examples of the predetermined timing at which the cleaning blade 54 is brought into contact with the surface of the second transfer belt 26 to clean the surface are as follows: when the image forming apparatus is switched on, when the cumulative number of the recording sheets 28 on which images have been formed reaches a predetermined value, when the cumulative number of revolutions of the photoconductor drum 14 reaches a predetermined value, and when the cumulative number of pixels of images formed on the photoconductor drum 14 reaches a predetermined value.

Figure 4:
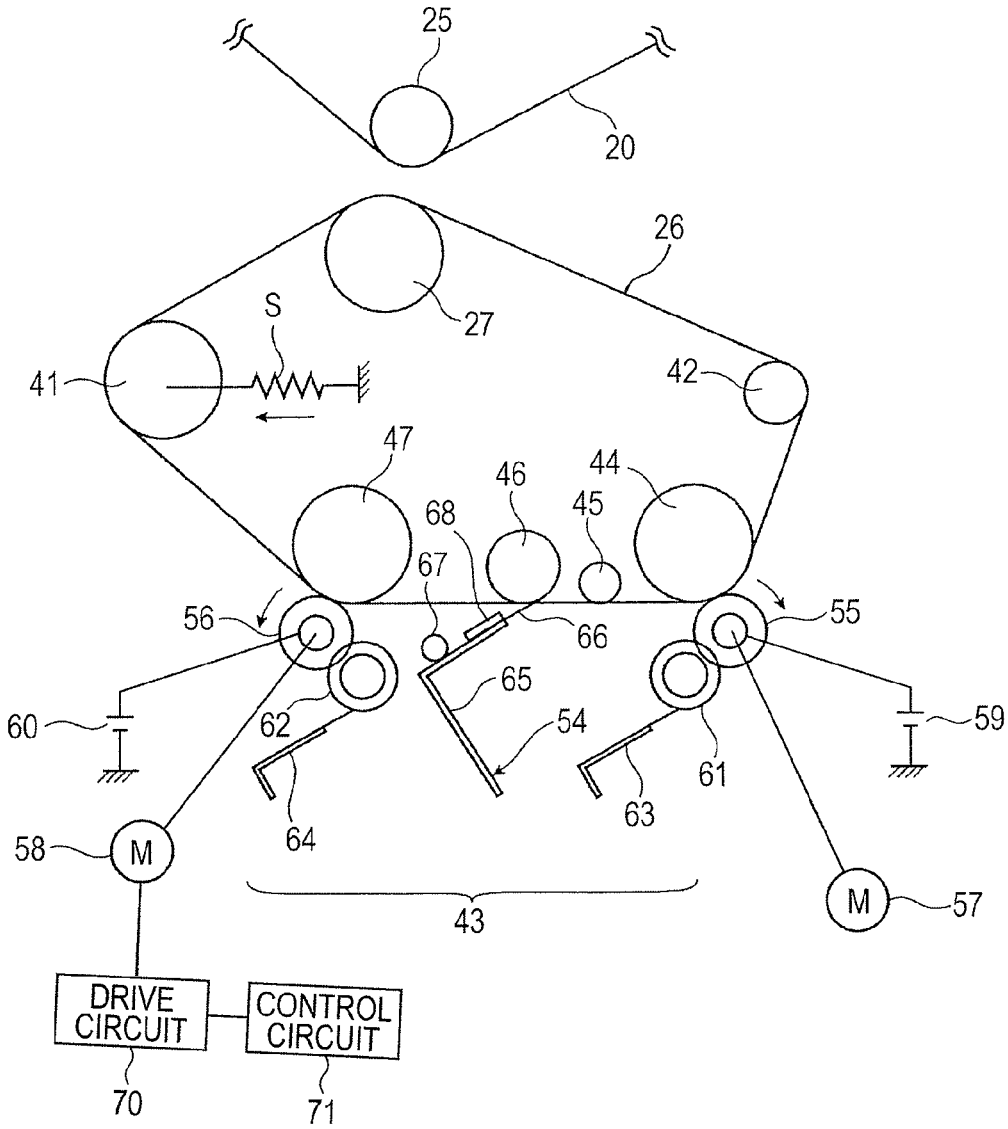
FIG. 4 illustrates an operation of the cleaning device.

The cleaning operation using the cleaning blade 54 is performed while, for example, the second transfer unit 40 is separated from the intermediate transfer belt 20 as illustrated in FIG. 4 by a contact/separation mechanism 401.

The cleaning blade 54 is brought into contact with and separated from the surface of the second transfer belt 26 at a predetermined timing in order to prevent the following failures that may occur if the cleaning blade 54 is always in pressed contact with the surface of the second transfer belt 26. If the cleaning blade 54 is made from a synthetic resin such as a polyurethane, friction between the cleaning blade 54 and the surface of the second transfer belt 26 is too high because friction-reducing effect due to toner is not expected because only a small amount of toner adheres to the second transfer belt 26, and thereby a failure such as abrasion of the cleaning blade 54 may occur. If the cleaning blade 54 is made from a metal, although abrasion does not occur, the surface of the second transfer belt 26 may be scratched by the cleaning blade 54, and thereby the life of the second transfer belt 26 may be shortened.

When the cleaning blade 54 scrapes the surface of the second transfer belt 26 at a predetermined scraping depth, the cleaning blade 54 is pressed against the surface with a load of about 15 N over a length of 300 mm in a widthwise direction, which intersects the movement direction of the second transfer belt 26. Thus, a load of about 15N is applied to the second transfer belt 26 when the cleaning blade 54 is in contact with the second transfer belt 26, and no load is applied to the second transfer belt 26 when the cleaning blade 54 is separated from the second transfer belt 26. Therefore, the load applied to the second transfer belt 26 varies widely and thereby the tension of the second transfer belt 26 varies widely depending on whether or not the cleaning blade 54 is in contact with the surface of the second transfer belt 26. However, the variation in the tension of the second transfer belt 26 is accommodated by the coil spring S, which supports the meandering control roller 41, and the like, so that the speed of the second transfer belt 26 only negligibly varies even if the tension of the second transfer belt 26 varies.

As illustrated in FIG. 1, the meandering control roller 41 applies a predetermined tension (for example, about 40 N) to the second transfer belt 26. Because the second transfer belt 26 is rotated by the second transfer roller 27 in the clockwise direction, the tension of the second transfer belt 26 is the highest between the meandering control roller 41 and the second transfer roller 27. The tension of the second transfer belt 26 decreases gradually from the second transfer roller 27 toward the peel-off roller 42, and the tension decreases further at positions at which the upstream cleaning brush 55 and the downstream cleaning brush 56 are in contact with the surface of the second transfer belt 26.

However, the tension of the second transfer belt 26, which decreases due to the contact with the upstream and downstream cleaning brushes 55 and 56 of the cleaning device 43 as described above, is not considerably affected by the upstream and downstream cleaning brushes 55 and 56 because these brushes are in contact with the second transfer belt 26 in substantially a constant manner, except when the cleaning blade 54 is brought into contact with and separated from the second transfer belt 26.

In contrast, when the cleaning blade 54 is brought into contact with and separated from the surface of the second transfer belt 26, a load applied to the second transfer belt 26 varies widely within the range of about 15 N and thereby a large variation in the tension of the second transfer belt 26 occurs. If such a large variation in the tension of the second transfer belt 26 occurs, control of meandering of the second transfer belt 26, which is performed by the meandering control roller 41, may become unstable. Moreover, the state of contact between the second transfer belt 26 and the cleaning brushes 55 and 56 and the cleaning blade 54 may become unstable, which may lead to a cleaning failure.

For this reason, in the present exemplary embodiment, the upstream cleaning brush 55 is disposed so as be in contact with a part of the surface of the second transfer belt 26 that is supported by the first support roller 44, and the downstream cleaning brush 56 is disposed so as to be in contact with a part of the surface of the second transfer belt 26 that is supported by the fourth support roller 47. Examples of residual substances remaining on the surface of the second transfer belt 26 include toner and toner additives, which have been transferred from the intermediate transfer belt 20, and paper dust of the recording sheet 28. The toner transferred from the intermediate transfer belt 20 includes toner that is charged with the negative polarity, which is the normal charge polarity; and toner that is charged with the positive polarity, which is opposite to the normal charge polarity, due to application of transfer biases at the first transfer position and the second transfer position.

As illustrated in FIG. 1, the two cleaning brushes 55 and 56 have similar structures. For example, the cleaning brushes 55 and 56 each include, for example, a core bar and a tape-shaped member. The core bar is made from a metal such as aluminium or a stainless steel. The tape-shaped member includes electroconductive filaments that are affixed thereto with a predetermined density, and the tape-shaped member is wound around the core bar with an electroconductive adhesive therebetween. The two cleaning brushes 55 and 56 are rotated at predetermined speeds by driving motors 57 and 58, which are examples of driving units and which are stepping motors or the like. The rotation direction of the downstream cleaning brush 56 is switchable between a direction opposite to the movement direction of the second transfer belt 26 and a direction that is the same as the movement direction of the second transfer belt 26 by a control circuit 71 through a drive circuit 70. Moreover, the rotation speed of the downstream cleaning brush 56 is also switchable by the control circuit 71. The filaments of the two cleaning brushes 55 and 56 may be nonconductive filaments. The number of cleaning brushes is not limited to two, and there may be three or more cleaning brushes as necessary.

The upstream cleaning brush 55, which is disposed on the upstream side in the movement direction of the second transfer belt 26, primarily removes residual toner adhering to the second transfer belt 26 and charged with the positive polarity, which is opposite to the normal charge polarity of toner. For this purpose, a bias voltage having the negative polarity, which is the same as the normal charge polarity, is applied to the upstream cleaning brush 55 by a first bias power supply 59. The downstream cleaning brush 56, which is disposed on the downstream side in the movement direction of the second transfer belt 26, primarily removes residual toner adhering to the second transfer belt 26 and charged with the negative polarity, which is the same as the normal charge polarity. For this purpose, a bias voltage having the positive polarity is applied to the downstream cleaning brush 56 by a second bias power supply 60. Alternatively, a bias voltage having the positive polarity, which is opposite to the normal charge polarity of toner, may be applied to the upstream cleaning brush 55, which is disposed on the upstream side in the movement direction of the second transfer belt 26; and a bias voltage having the negative polarity, which is the same as the normal charge polarity of toner, may be applied to the downstream cleaning brush 56, which is disposed on the downstream side in the movement direction of the second transfer belt 26. However, because toner that adheres to the second transfer belt 26 is more likely to have the opposite polarity due to application the first transfer bias voltage or the second transfer bias voltage, the toner may be first removed by applying a negative bias voltage to the upstream cleaning brush 55.

Recovery rollers 61 and 62 are disposed so as be in contact with the back sides of the two cleaning brushes 55 and 56. The recovery rollers 61 and 62 are metal rollers or metal brush rollers that are, for example, grounded. The recovery rollers 61 and 62 recover residual substances such as toner, which have been removed by the two cleaning brushes 55 and 56, by electrostatically attracting the residual substances. Then, recovery blades 63 and 64, which are in pressed contact with the surfaces of the recovery rollers 61 and 62, scrape off the residual substances from the recovery rollers 61 and 62, and the residual substances are contained in a housing 69 of the cleaning device 43, which also serves as a recovery container. As necessary, the recovery rollers 61 and 62 are rotated in directions opposite to the rotation directions of the cleaning brushes 55 and 56 by the driving motors 57 and 58 through gears or the like. Alternatively, toner and the like may be recovered from the two cleaning brushes 55 and 56 not by using the recovery rollers 61 and 62 but by using bar-shaped or plate-shaped flicker members that are disposed so as to be in contact with surfaces of the cleaning brushes 55 and 56.

Among the two cleaning brushes 55 and 56, the upstream cleaning brush 55 is disposed so as to be in contact with a part of the surface of the second transfer belt 26 that is supported by the first support roller 44 with a constant load that is in a predetermined range. The cleaning brush 55 rotates in a direction opposite to the movement direction of the surface of the second transfer belt 26. Therefore, the upstream cleaning brush 55, which is rotated in the opposite direction while being in pressed contact with the surface of the second transfer belt 26, applies a substantially constant load to the second transfer belt 26. Even if the tension of the second transfer belt 26 varies when the cleaning blade 54, which is disposed downstream of the upstream cleaning brush 55, is brought into contact with and separated from the surface of the second transfer belt 26, the variation in the tension of the second transfer belt 26 is prevented from transmitted upstream.

Among the two cleaning brushes 55 and 56, the downstream cleaning brush 56 is disposed so as to be in contact with a part of the surface of the second transfer belt 26 that is supported by the fourth support roller 47 with a constant load that is in a predetermined range. If the tension of the second transfer belt 26 varies when the cleaning blade 54, which is located upstream of the downstream cleaning brush 56, is brought into contact with and separated from the surface of the second transfer belt 26, the contact state of the downstream cleaning brush 56 is changed from a first contact state to a second contact state by changing at least one of the rotation speed and the rotation direction of the cleaning brush 56 in accordance with the movement of the cleaning blade 54 with which the cleaning blade 54 is brought into contact with and separated from the surface of the second transfer belt 26. Thus, the downstream cleaning brush 56 serves to reduce the variation in the tension of the second transfer belt 26 when the cleaning blade 54 is brought into contact with and separated from the second transfer belt.

To be specific, as illustrated by a solid line in FIG. 1, when the cleaning blade 54 is separated from the surface of the second transfer belt 26, the downstream cleaning brush 56 is in the first contact state in which the downstream cleaning brush 56 is rotated in a direction opposite to the movement direction of the second transfer belt 26 at a predetermined rotation speed.

On the other hand, as illustrated in FIG. 4, when the cleaning blade 54 is in contact with the surface of the second transfer belt 26, the downstream cleaning brush 56 is in the second contact state in which the downstream cleaning brush 56 is rotated in the direction opposite to the movement direction of the second transfer belt 26 at a speed smaller than the predetermined rotation speed or the downstream cleaning brush 56 is rotated in the movement direction of the second transfer belt 26 at a predetermined rotation speed.

With the structure described above, the image forming apparatus including the cleaning device according to the present exemplary embodiment is capable of preventing a variation in the tension of the endless belt, which may occur when the cleaning member is brought into contact with and separated from the surface of the endless belt, in the following manner.

That is, as illustrated in FIG. 2, in the image forming apparatus including the cleaning device 43 according to the present exemplary embodiment, the image forming units 13Y, 13M, 13C, and 13K respectively form toner images of yellow (Y), magenta (M), cyan (C), and black (K) on the photoconductor drums 14Y, 14M, 14C, and 14K. The toner images, which have been formed on the photoconductor drums 14Y, 14M, 14C, and 14K of the image forming units 13Y, 13M, 13C, and 13K are overlappingly first-transferred to the intermediate transfer belt 20. Then, the toner images are simultaneously second-transferred from the intermediate transfer belt 20 to the recording sheet 28 by the second transfer unit 40 at the second transfer position.

As illustrated in FIG. 2, the recording sheet 28, to which toner images of yellow (Y), magenta (M), cyan (C), and black (K) have been simultaneously second-transferred, is peeled off the second transfer belt 26 of the second transfer unit 40. Then, the recording sheet 28 is transported to the fixing device 30 by the transfer belt 29, is heated and pressed by the fixing device 30 so as to fix the toner images thereto, and is output to the output tray 31, which is disposed outside of the image forming apparatus body 1.

As illustrated in FIG. 2, in the image forming apparatus, the second transfer belt 26 of the second transfer unit 40 rotates while being in direct contact with the intermediate transfer belt 20. Therefore, residual substances, such as toner and toner additives adhering to or remaining on the surface of the intermediate transfer belt 20 and paper dust of the recording sheet 28, are likely to directly adhere to the surface of the second transfer belt 26. Moreover, corona by-products composed of $NO_x$ and the like are likely to adhere to the surface of the second transfer belt 26 at the second transfer position. If toner adheres to the surface of the second transfer belt 26, the back side of the recording sheet 28 may become smudged. If toner additives, paper dust, and the like become deposited on the surface of the second transfer belt 26, second-transfer failure may occur.

To prevent this, as illustrated in FIGS. 1 and 2, the present exemplary embodiment includes the cleaning device 43 for cleaning the surface of the second transfer belt 26.

As illustrated in FIGS. 1 and 2, in the cleaning device 43 for cleaning the second transfer belt, when the image forming apparatus is performing a normal image forming operation, the two cleaning brushes 55 and 56 are constantly in contact with the surface of the second transfer belt 26 and are rotated in a direction (clockwise direction) that is opposite to the movement direction of the second transfer belt 26. A negative bias voltage is applied to the upstream cleaning brush 55, which is disposed upstream of the cleaning brush 56 in the movement direction of the second transfer belt 26, so that the upstream cleaning brush 55 removes toner that has been charged with a polarity opposite to the normal charge polarity (negative polarity). A positive bias voltage is applied the downstream cleaning brush 56, which is disposed downstream of the cleaning brush 55 in the movement direction of the second transfer belt 26, so that the downstream cleaning brush removes toner that has been charged with the normal charge polarity.

Therefore, toner charged with the polarity opposite to the normal charge polarity and toner charged with the normal charge polarity, which adhere to the surface of the second transfer belt 26, are removed from the surface of the second transfer belt 26 by a physical scraping effect due to the rotation of the two cleaning brushes 55 and 56 and the electrostatic attraction force. Then, the toner is recovered into the housing 69 of the cleaning device 43.

At this time, as illustrated by a solid line in FIG. 1, the cleaning blade 54 is located at a position at which the cleaning blade 54 is separated from the surface of the second transfer belt 26.

As described above, with the image forming apparatus, toner adhering to the surface of the second transfer belt 26 and charged with the polarity opposite to the normal charge polarity and toner adhering to the surface of the second transfer belt 26 and charged with the normal charge polarity are removed by the two cleaning brushes 55 and 56. However, residual substances such as toner additives and paper dust, whose particle diameter is smaller than that of the toner adhering to the surface of the second transfer belt 26, may not be sufficiently removed by the two cleaning brushes 55 and 56, and the residual substances may gradually become deposited on the surface of the second transfer belt 26 and adhere to the surface in a film-like shape.

To prevent this, as illustrated in FIG. 4, with the cleaning device 43 according to the present exemplary embodiment, the second transfer unit 40 is separated from the intermediate transfer belt 20 and the cleaning blade 54 is pressed into contact with the surface of the second transfer belt 26 at a predetermined timing, and thereby residual substances such as toner additives and paper dust adhering to the surface of the second transfer belt 26 in a film-like shape are scraped off by the cleaning blade 54. In FIG. 4, the cleaning blade 54 is located at a position at which the cleaning blade 54 is in pressed contact with the surface of the second transfer belt 26 and the cleaning blade 54 scrapes the surface of the second transfer belt 26 at a predetermined scraping depth.

Residual substances, such as toner additives and paper dust, adhering to the surface of the second transfer belt 26 in a film-like shape are reliably removed by the cleaning blade 54, which is pressed into contact with the surface of the second transfer belt 26. However, when the cleaning blade 54 is pressed into contact with the surface of the second transfer belt 26, a load applied to the second transfer belt 26 is increased, and variation in the tension of the second transfer belt 26 occurs.

When variation in the tension of the second transfer belt 26 occurs, the meandering control roller 41 may fail to control meandering of the second transfer belt 26. Moreover, the cleaning performance of the cleaning blade 54 of the cleaning device 43 and the two cleaning brushes 55 and 56 may decrease.

Figure 5:
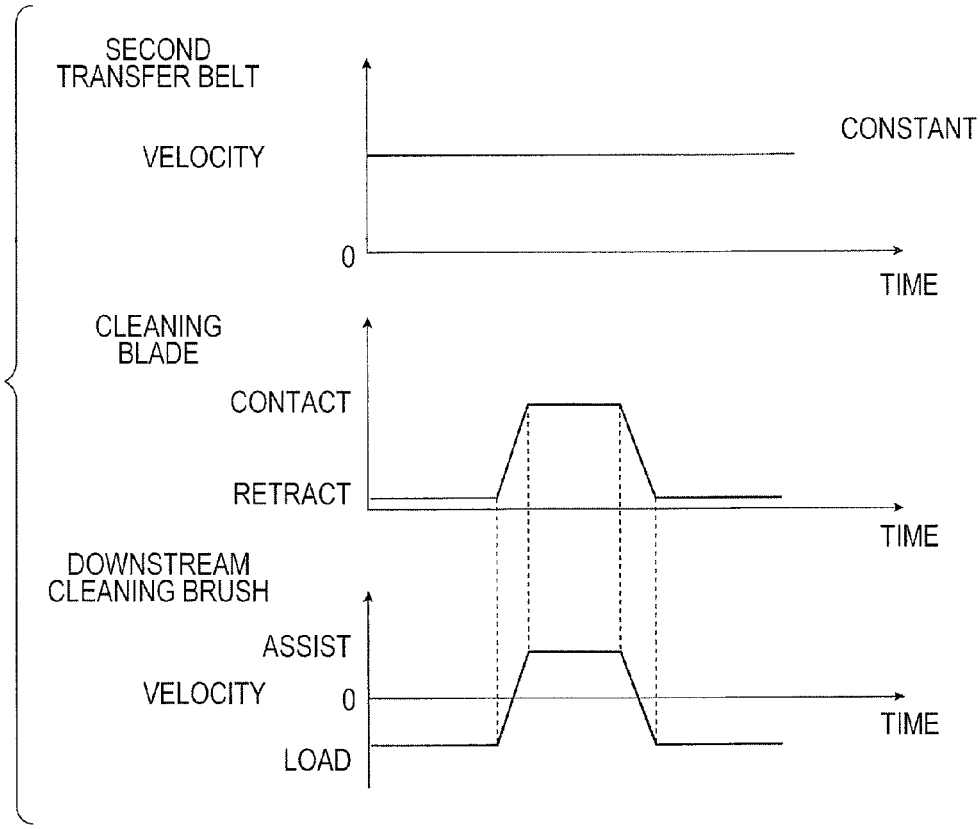
FIG. 5 is a timing chart of the operation of the cleaning device.

To prevent this, in the present exemplary embodiment, as illustrated in FIG. 5, in synchronism with the operation of pressing the cleaning blade 54 into contact with the surface of the second transfer belt 26 so as to clean the surface, the control circuit 71 switches the rotation speed of the downstream cleaning brush 56 to a second speed that is lower than the normal speed or switches the rotation direction of the downstream cleaning brush 56 to the opposite direction, thereby reducing a load applied to the downstream cleaning brush 56 and preventing an increase in a driving load of the second transfer belt 26. Thus, even when the cleaning blade 54 is pressed into contact with the surface of the second transfer belt 26, occurrence of a large variation in the tension of the second transfer belt 26 is prevented. At this time, bias voltages are not applied to the two cleaning brushes 55 and 56.

In the present exemplary embodiment, if switching the rotation speed of the downstream cleaning brush 56 to the second speed, which is lower than the normal speed, is ineffective, the rotation direction of the downstream cleaning brush 56 is changed to the opposite direction, which is opposite to the normal rotation direction, to assist driving of the second transfer belt 26. Thus, a large variation in the tension of the second transfer belt 26, which may occur when the cleaning blade 54 is pressed into contact with the surface of the second transfer belt 26, is more reliably prevented.

Figure 6:
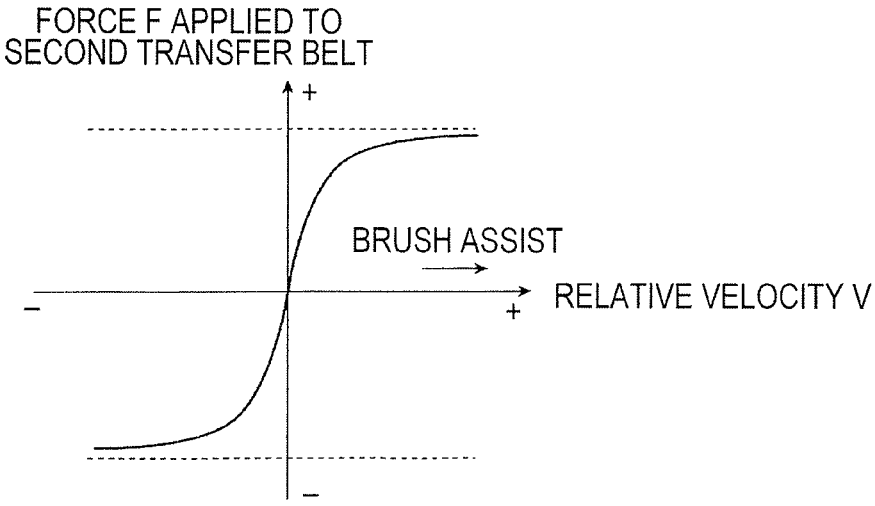
FIG. 6 is a graph illustrating the relationship between the speed and direction of rotation of a brush roller and a force applied to a second transfer belt.

When the rotation speed and the rotation direction of the cleaning brush 56 are changed, a physical force F applied by the downstream cleaning brush 56 to the second transfer belt 26 changes as illustrated in FIG. 6.

As is clear from FIG. 6, when the rotation speed of the downstream cleaning brush 56 decreases, the force F as a load applied to the second transfer belt 26 decreases. When the rotation direction of the downstream cleaning brush 56 is switched to the opposite direction, the force F as a load applied to the second transfer belt 26 becomes positive, i.e., the force F assists driving of the second transfer belt 26, and thereby occurrence of variation in the tension of the second transfer belt 26 is more reliably prevented.

Second Embodiment

Figure 7:
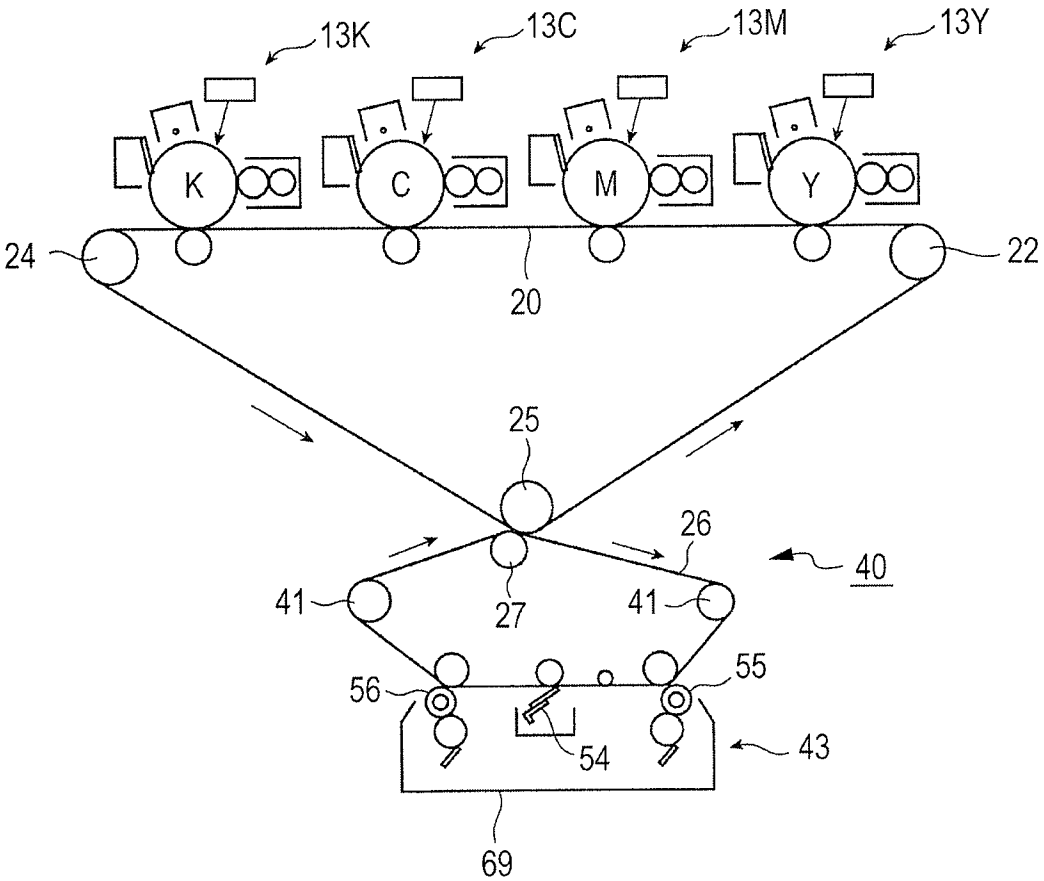
FIG. 7 is a schematic view of an image forming apparatus including a cleaning device according to a third exemplary embodiment of the present invention.

FIG. 7 illustrates a second exemplary embodiment of the present invention. Components that are the same as those of the first exemplary embodiment will be denoted by the same numerals. In the second exemplary embodiment, the second transfer belt is always in contact with the intermediate transfer member.

That is, in the second exemplary embodiment, as illustrated in FIG. 7, the second transfer belt 26 is not separable from the intermediate transfer belt 20, and the second transfer belt 26 is always in contact with the intermediate transfer belt 20.

In this case, the contact/separation mechanism 401 is not necessary, so that the structure of the image forming apparatus is simplified. Moreover, it is not necessary to make the second transfer belt 26 be separable from the intermediate transfer belt 20, and thereby the productivity of the image forming apparatus is increased.

Description of other structures and functions, which are the same as those of the first exemplary embodiment, will be omitted.

In the exemplary embodiments described above, as illustrated in FIG. 1, a cleaning blade is used as a first cleaning member. However, instead of the cleaning blade, a cleaning roller may be used as the first cleaning member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a first cleaning member that is brought into contact with and separated from a surface of an endless belt at a predetermined timing and cleans the surface, the endless belt being looped over a plurality of rollers including a driving roller;

a second cleaning member that cleans the surface of the endless belt, the second cleaning member being disposed upstream of the first cleaning member and downstream of the driving roller in a movement direction in which the endless belt moves, the second cleaning member being in contact with the endless belt so as to prevent a tension variation in a tension of the endless belt from affecting the driving roller, the tension variation occurring when the first cleaning member is brought into contact with and separated from the endless belt; and a third cleaning member that cleans the surface of the endless belt, the third cleaning member being disposed downstream of the first cleaning member in the movement direction of the endless belt, a contact state in which the third cleaning member is in contact with the endless belt being switched from a first contact state to a second contact state so as to reduce the tension variation, which occurs when the first cleaning member is brought into contact with and separated from the endless belt, wherein the third cleaning member is in contact with the endless belt in both the first contact state and the second contact state.

2. The cleaning device according to claim 1, wherein the second cleaning member includes a rotatable cleaning brush that is in contact with the surface of the endless belt with a predetermined load.

3. The cleaning device according to claim 1, wherein the third cleaning member includes a rotatable cleaning brush, and the contact state in which the third cleaning member is in contact with the endless belt is changed from the first contact state to the second contact state by controlling at least one of a rotation speed and a rotation direction of the cleaning brush.

4. The cleaning device according to claim 1, wherein the second cleaning member and the third cleaning member are configured such that the second cleaning member and the third cleaning member always contact the endless belt during normal operation of the cleaning device.

5. An image forming apparatus comprising:

at least one image carrier that carries a toner image;

an intermediate transfer member to which the toner image is transferred from the image carrier;

an endless second transfer belt that transfers the toner image from the intermediate transfer member to a recording medium; and a cleaning unit that cleans the second transfer belt, wherein the cleaning device according to claim 1 is used as the cleaning unit.

6. The image forming apparatus according to claim 5, wherein the second transfer belt is looped over a plurality of rollers including a second transfer roller, a meandering control roller, and a peel-off roller; the second transfer roller is disposed at a second transfer position at which the second transfer belt is in contact with the intermediate transfer member, the second transfer roller driving the second transfer belt; the meandering control roller is disposed upstream of the second transfer roller in a movement direction in which the second transfer belt moves, the meandering control roller controlling meandering of the second transfer belt; and the peel-off roller is disposed downstream of the second transfer roller in the movement direction of the second transfer belt, the peel-off roller peeling the recording medium off the second transfer belt.

7. The image forming apparatus according to claim 5, wherein the second transfer belt is disposed so as to be brought into contact with and separated from the intermediate transfer member, and the second transfer roller is rotated by a driving unit at a circumferential speed that is larger than a movement speed of the intermediate transfer member through a torque limiter that transmits only a torque that is equal to or smaller than a set value.

8. The image forming apparatus according to claim 5, wherein the second transfer belt is disposed so as to be always in contact with the intermediate transfer member.

* * * * *